US008643286B2

(12) United States Patent
Schenk et al.

(10) Patent No.: US 8,643,286 B2
(45) Date of Patent: Feb. 4, 2014

(54) ILLUMINATION SYSTEM AND METHOD FOR PROCESSING LIGHT

(75) Inventors: Tim Corneel Wilhelmus Schenk, Eindhoven (NL); Lorenzo Feri, Eindhoven (NL); Paulus Henricus Antonius Damink, Eindhoven (NL); Johan Paul Marie Gerard Linnartz, Eindhoven (NL); Hongming Yang, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 569 days.

(21) Appl. No.: 12/990,519

(22) PCT Filed: Apr. 27, 2009

(86) PCT No.: PCT/IB2009/051705

§ 371 (c)(1), (2), (4) Date: Nov. 1, 2010

(87) PCT Pub. No.: WO2009/136309

PCT Pub. Date: Nov. 12, 2009

(65) Prior Publication Data

US 2011/0043116 A1 Feb. 24, 2011

(30) Foreign Application Priority Data

May 6, 2008 (EP) ..... 08155685

(51) Int. Cl.
*H05B 37/02* (2006.01)

(52) U.S. Cl.
USPC ..... 315/152; 315/308

(58) Field of Classification Search
USPC ..... 315/291, 292, 307, 308, 312, 152; 340/472, 475, 479, 825.2, 825.21, 340/825.22
See application file for complete search history.

(56) References Cited

U.S. PATENT DOCUMENTS

| | | | | |
|---|---|---|---|---|
| 7,332,877 | B2 * | 2/2008 | Crodian et al. | 315/297 |
| 2006/0188254 | A1 | 8/2006 | Schorpp | |
| 2007/0008258 | A1 | 1/2007 | Yamamoto | |

FOREIGN PATENT DOCUMENTS

| | | | |
|---|---|---|---|
| WO | 2006111927 | A1 | 10/2006 |
| WO | 2006111930 | A2 | 10/2006 |
| WO | 2007052197 | A1 | 5/2007 |
| WO | 2008050293 | A1 | 5/2008 |
| WO | 2008053422 | A1 | 5/2008 |
| WO | 2009010926 | A1 | 1/2009 |

* cited by examiner

*Primary Examiner* — Jimmy Vu

(57) ABSTRACT

Proposed is an illumination system (100) comprising a plurality of light sources (10) provided with encoders (20) arranged to enable light emitted from the light sources to comprise light source identification codes. In order to enable light effect commissioning, i.e. correlating the light sources (10) with their illumination footprints (11), the system further comprises a camera (40) arranged to register images of illumination spots (11), and a signal processor (111) arranged to derive the light source identification codes from registered images. Arranging the encoders (20) to modulate the light emitted at a frequency above a predefined high level to comprise fast codes (12) and at a frequency below a predefined low level to comprise slow codes (13), beneficially allows for the use of simple low cost camera systems.

7 Claims, 4 Drawing Sheets

ILLUMINATION SYSTEM AND METHOD FOR PROCESSING LIGHT

FIELD OF THE INVENTION

The invention relates to an illumination system and a method for processing light. Such systems and methods are in particular useful in the creation of illumination supported atmospheres and the light effect commissioning of the systems' light sources.

BACKGROUND OF THE INVENTION

Such systems and methods (as described f.i. in European Patent Application 07112664.3) for processing light in a structure, f.i. a room or a part thereof, a lobby, a vehicle, etc., typically include the arrangement of several light sources in the structure. The light sources emit light carrying individual codes, identifying the light source. Arranging a camera in a camera-position of the structure and registering images of spots of the light allows through the identification of the individual codes which light source contributes to an illumination pattern. The spots can be, for instance, illuminated areas on a floor, a wall, or ceiling. The image may even include the direct light images of a light source. Besides deriving the individual codes from the registered images, a signal processing apparatus can also determine one or more properties (such as for instance light source position, light intensity, color point, etc) related to the associated light source. A typical application of the system and method is light effect commissioning and real time foot-print measurements.

As the light modulations necessary to incorporate the light source identification codes typically are well over 1000 Hz (allowing both invisibility to the human eye and a large bandwidth for data transfer), the known system needs to incorporate a high speed camera to distinguish the codes and consequently the footprints of the different light sources in the illumination system. This results in a high cost solution.

SUMMARY OF THE INVENTION

The invention has as an objective providing an illumination system and method for processing light of the kind set forth which allows the use of low cost camera systems while still maintaining embedded codes invisible to the human eye and a sufficiently large bandwidth for data transfer. This object is achieved with the illumination system according to a first aspect of the invention as defined in claim 1. An illumination system comprising a plurality of light sources provided with an encoder arranged to enable light emitted from the light sources to comprise light source identification codes, a camera arranged to register images of illumination spots of the light emitted from the light sources, a signal processor arranged to derive the light source identification codes from registered images, CHARACTERIZED IN THAT the encoder is arranged to modulate the light emitted at a frequency above a predefined high level to comprise fast codes and at a frequency below a predefined low level to comprise slow codes. The invention provides an illumination system that advantageously allows the use of cheap slow camera systems for the light effect commissioning of the light sources and the determination of their footprints.

In an embodiment wherein the high level is 100 Hz and the low level is 10 Hz. Advantageously, this allows the light modulations to be practically invisible for the human eye. These values are based on the insight that the temporal sensitivity of the human eye is highly non-linear. At typical illumination levels of 100-500 lux the human eye's sensitivity as a function of the length of a light flash (i.e. the inverse of the code switching frequency) shows a very low sensitivity below 0.01 s (above 100 Hz). This allows for the fast code to be invisible. Moreover, the eye sensitivity decreases rapidly for pulse durations above 0.1 s (below 10 Hz) and leveling-off to a low sensitivity long pulse tail. Thus, as the long pulse tail does not reduce to zero the human visual system allows for the incorporation of slow codes in the light emitted at sufficiently small amplitudes to be visible for the camera while being invisible for the human eye. Low cost slow camera systems typically have a frame rate of 25-50 frames/s, excellently suitable for the detection of the slow codes in the foot print images.

According to an embodiment the illumination system further comprising a remote control device comprising a photosensor arranged to detect the fast codes allowing for rapid interaction of a user with the system.

In an embodiment the slow code modulation is arranged to be in a predefined depth range enabling it to be invisible for the human eye while detectable for the camera.

In an embodiment, at least four light sources are comprised in a light module, each of these light sources arranged to emit a primary color, and the light module is arranged to emit light at a desired intensity and color point (xyY), wherein further the encoders are arranged to implement the slow codes as a modulation in the relative contribution of the primary colors to the intensity and color point (xyY). Advantageously, the human eye will not see any difference in (i) intensity (Y) and (ii) color point (xy) of a logical "1" and "0" according to this modulation scheme. In other words, no flickering will be observed. Moreover, there is no need to use a color sensitive camera (a simple black-white camera suffice) for registering the illuminations foot-prints of the different light modules, as the coding/data is embedded in the relative contribution of the primary colors to the xyY point. The only requirement is that the camera/sensor has a wavelength dependent response different form $V_\lambda$, such that the logical "1" and logical "0" result in a different output level. This is the case for typical cameras and photo sensors. When a color camera/sensor is used, additionally the color of the foot-print can be measured.

In an embodiment of the invention the encoder 20 is arranged to implement the fast codes and slow codes using a spread spectrum technique. Advantageously, this allows the fast and slow codes to be detected without detrimental interference between the two.

According to a second aspect, the invention provides a light module comprising a plurality of light sources provided with an encoder arranged to enable light emitted from the light sources to comprise light source identification codes characterized in that the encoder is arranged to modulate the light emitted at a frequency above a predefined high level to comprise fast codes and at a frequency below a predefined low level to comprise slow codes.

According to a third aspect, the invention provides a method for processing light originating from an illumination system in a structure, the illumination system comprising a plurality of light sources, comprising the steps (i) driving the light sources to emit light forming illumination spots, (ii) embedding light source identification codes in the light emitted, (iii) arranging a camera in the structure enabling it to register the illumination spots, (iv) deriving the light source identification codes from the images registered, and (v) embedding the light source identification codes in the light emitted as fast codes at a frequency above a predefined high level and as slow codes at a frequency below a predefined low level.

These and other aspects of the invention will be apparent from and elucidated with reference to the embodiments described hereinafter.

BRIEF DESCRIPTION OF THE DRAWINGS

Further details, features and advantages of the invention are disclosed in the following description of exemplary and preferred embodiments in connection with the drawings.

DETAILED DESCRIPTION OF THE EMBODIMENTS

Figure 1:
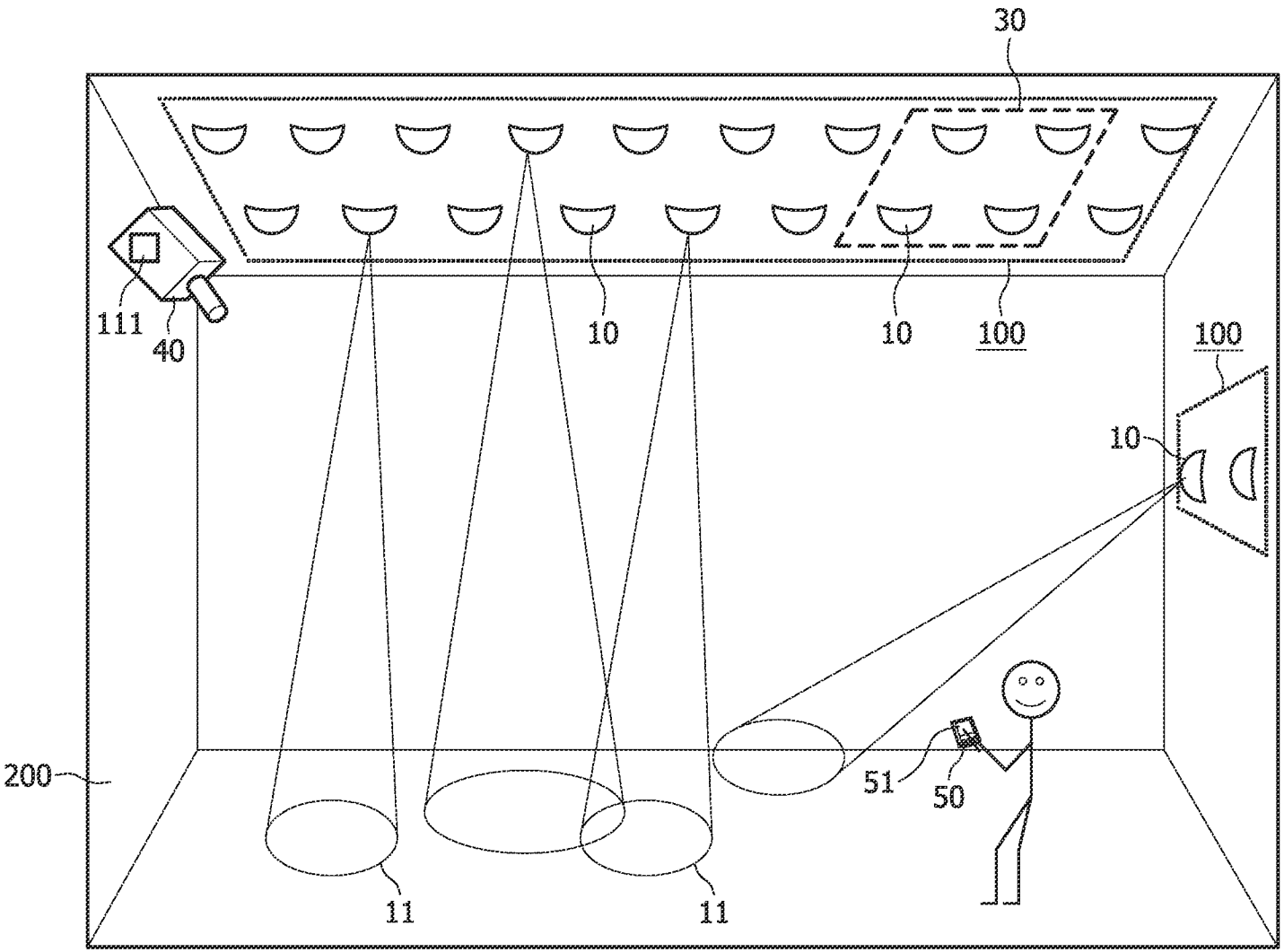
FIG. 1 shows an embodiment of the illumination system installed in a structure
Figure 2:
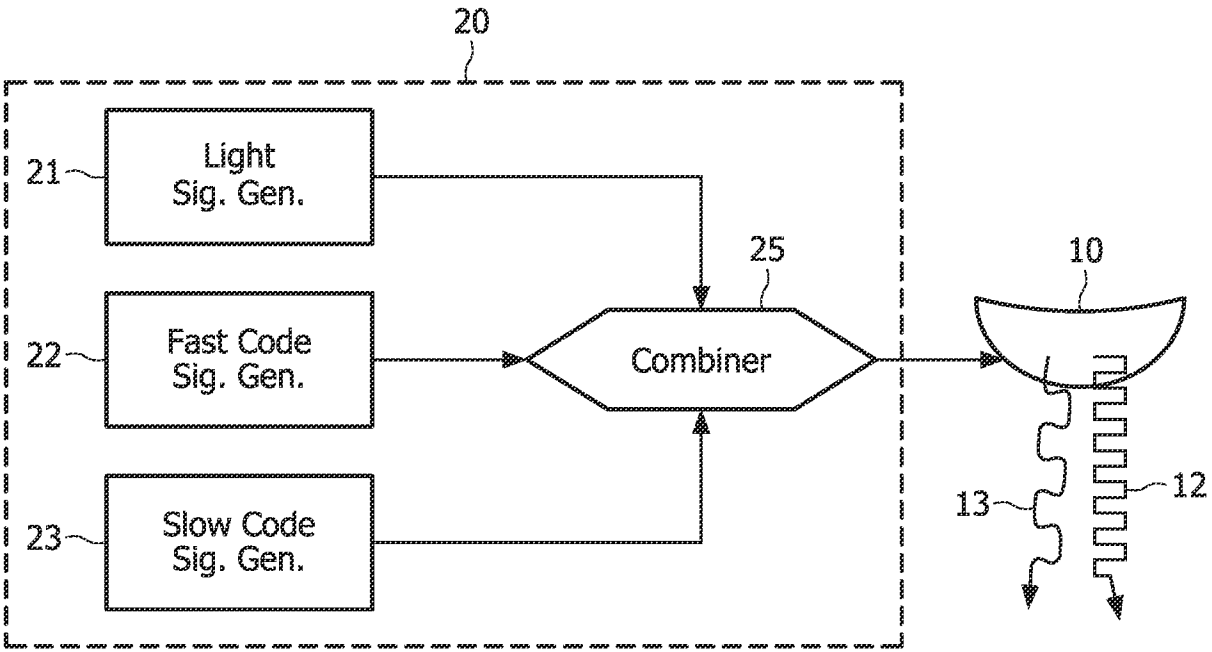
FIG. 2 shows en embodiment of the encoder for generation of fast and slow codes in the light emitted from the light sources

FIG. 1 shows structure 200—in this case a room—with an installed illumination system 100. The illumination system comprises a plurality of light sources 10, provided with an encoder (20—see FIG. 2) arranged to enable light emitted from the light sources to comprise light source identification codes. The light source may for instance be high/low pressure gas discharge bulbs, inorganic/organic LEDs, or laser diodes. Possibly several light sources 10 may be combined in a light module 30. The illumination system further comprises a camera 40 placed in the structure 200 enabling it to register images of illumination spots 11 of the light emitted from the light sources 10. A signal processor 111, f.i. incorporated in the camera 40 or in the master controller (110—see FIG. 3) of the illumination system 100, is arranged to derive the light source identification codes from registered images. Through the determination of the light source identification codes, it is possible to correlate the light sources 10 with the foot print of their illumination spots 11. Making this correlation, also known as light effect commissioning, enables a user to intuitively create illumination atmospheres using a remote control device 50 comprising a photo-sensor 51. The remote control device interacts with the system for instance through a wireless RF link.

The encoder 20 (FIG. 2) is arranged to provide a driving signal to the light source 10 including three elements. It comprises (i) a light signal generator 21 for creating the desired illumination, (ii) a fast code signal generator 22 for modulating the light emitted from the light sources 10 at a frequency above a predefined high level to comprise fast codes 12, and (iii) a slow code signal generator 23 for modulating the light emitted at a frequency below a predefined low level to comprise slow codes 13. Preferably, the fast code 12 is clocked at frequencies above 100 Hz and the slow code 13 is clocked below 10 Hz. All three signals are combined in a combiner 25 and fed to a driver (not shown) of the light source 10.

Figure 3:
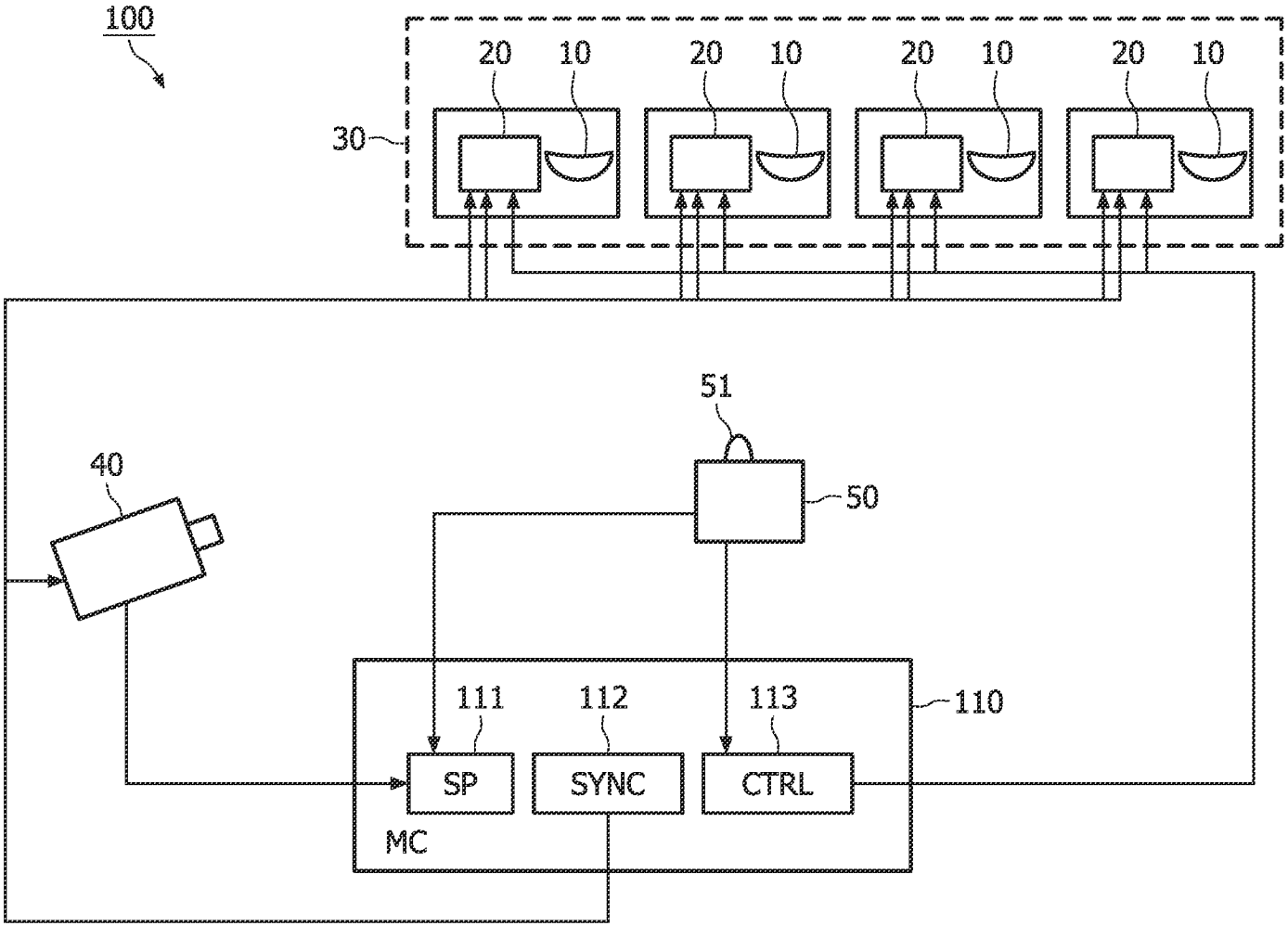
FIG. 3 shows an embodiment of the illumination system

In an embodiment, the master controller 110 comprises a signal processor 111, a synchronization unit 112, and a control unit 113 (FIG. 3). In this embodiment the lighting system is fully synchronized, i.e. the light sources 10 (via the encoder 20) and the camera 40 are all connected to and synchronized by the synchronization unit 112, essentially a reference frequency generator. More particularly, the fast code signal generator 22 and slow code signal generator 23 in the encoder 20 are connected with the synchronization unit 112. Implementation of the code signals by the encoder will be discussed below. The control unit 113 is connected to the light signal generator 21 for controlling the light output of the light sources 10, for example as regards intensity, and/or color, etc.

In an alternative embodiment the illumination system 100 operates asynchronous. Previously it has sometimes been desirable to separate the emission of light from different light sources 10 in time, in order to be able to detect the light emitted from a single light source at a time. Through the use of the light source identification codes, however, there is no need for synchronization in time of the light sources. Instead, the light sources 10 can work in asynchronous mode, embedding identification codes non-synchronously.

Advantageously, the light effect commissioning of the light sources 10 and their illumination foot prints 11 uses the slow codes 13 in combination with a low-cost camera 40. It will be clear that the light effect commissioning need only be done during an initiation step after installation of the illumination system 100 in the structure 200 (or after a major refurbishment of the structure reallocating objects such as cupboards, couches, tables, light sources, etc, within it). Hence, a user may, f.i. using the remote control device 50, toggle the illumination system 100 turn embedding the slow codes on or off. Once the light effect commissioning has been performed a user may create (note that the light effect commissioning data correlating the light sources with the illumination footprints may be stored and retrieved from a memory device in the system, f.i. comprised in the control unit 113) a desired illumination atmosphere using the remote control device 50 and the fast codes 12 embedded in the light emitted from the light sources 10. A photo-sensor 51 comprised in the remote control device enables detecting the fast codes and at least one lighting property (such as intensity, color point, etc) related to the associated light source 10. Through the wireless link between the remote control device 50 and the master controller 110 of the illumination system 100, a user may request the system to provide a desired illumination, may control the lighting property of the illumination, and may provide a feedback signal to the system in order to correct any deviations from the desired lighting property.

Embedding simultaneously a fast code 12 and a slow code 13 in the light emitted without proper design results in interference between the two coding signals, detrimental to realizing the desired illumination atmosphere. In an embodiment the fast and slow codes 12,13 are implemented using a spread spectrum technique. Such a technique is known as "code-division multiplexing/multiple access" (CDM or CDMA). To each lighting source 10, or to each group of one or more light sources 10, a unique code is allocated. The codes must be orthogonal, that is, a value of an autocorrelation of a code must be significant higher than a value of a cross-correlation of two different codes. A sensing device, such as the camera 40 or the photo-sensor 51, is then able to discriminate between simultaneously transmissions of modulated light by different light sources 10, so that the sensing device can identify each of them. Furthermore, the sensing device can measure a lighting property (intensity, color point, etc) of the modulated light received from the identified light source 10. For each sensed emission of modulated light the sensing device transfers data containing an identification of the emitting light source 10 and a value of the measured lighting property to the master controller 110. Having acquired such data the master controller is able to control light sources 10, changing the intensity or color point of the light emitted to meet the desired light effects in an area around the sensing device.

Figure 4:
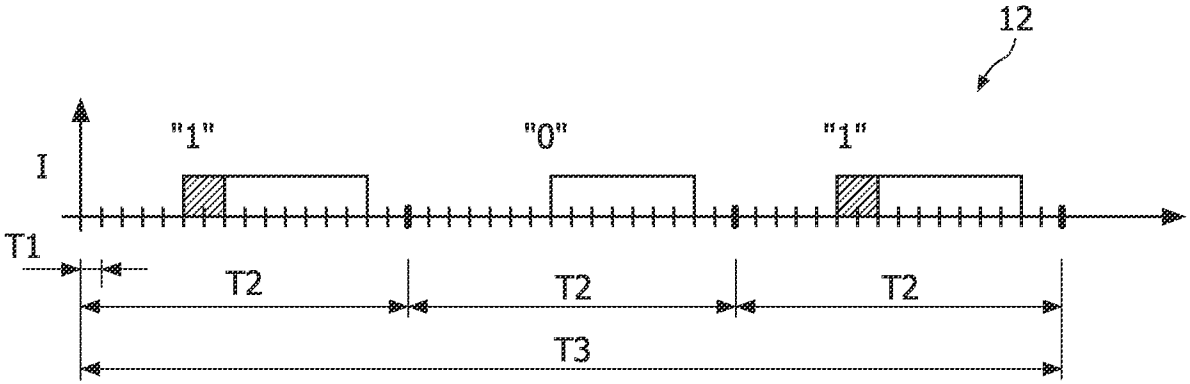
FIG. 4 shows a modulation scheme embedding the fast codes in the light emitted by the light sources

FIG. 4 shows a time diagram explaining the spread spectrum modulation technique for modulating light emitted by a light source 10 with the fast codes 12. As the light sources have a maximum frequency by which their emitted light can be modulated, the inverse of the maximum frequency defines a minimum modulation interval. A clock signal is generated providing pulses having a cycle time which is greater than the minimum modulation interval. It is assumed here that the clock cycle time is period T1. In every period T2 a data bit is transmitted, for instance by means of pulse width modulation (PWM). Using this modulation scheme, an illumination pulse is extended when a logical "1" is transmitted relative to the illumination pulse when a logical "0" is transmitted (see the grey parts of the pulses). In a period T3 a complete code is transmitted, identifying the light source 10 (in this case the code "101"). T3 is chosen to be short enough to make the on/off modulation of the light pulses not perceivable by the human eye. As the transmitted duty cycles should on average meet the illumination constraints (desired intensity, color, or lux level), the use of balanced codes like Walsh-Hadamard is beneficial.

Figure 5:
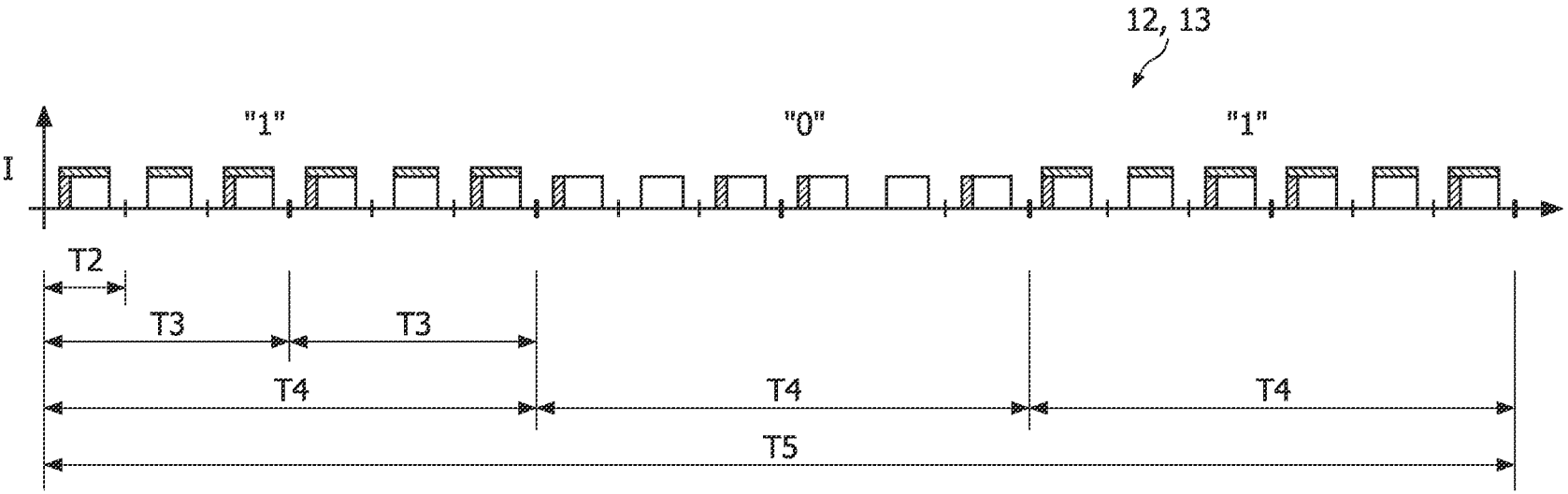
FIG. 5 shows a modulation scheme embedding the slow codes in the light emitted by the light sources

FIG. 5 explains implementing the slow codes 13. As explained previously, the slow codes need to have a frequency below about 10 Hz to remain invisible for the human eye while simultaneously detectable by low cost cameras. Defining a period T4 for transmitting a bit of the slow code 13, where T4 equals a multiple of T3 for the fast and slow codes 12, 13 not to interfere, a complete slow code will be transferred in a period T5 (T5 itself being a multiple of T4). In this embodiment the slow codes are implemented using pulse amplitude modulation (PAM), in which the height of the illumination pulse (i.e. the intensity of the light emitted) is increased to transmit a logical "1" relative to the height of the pulse transmitting a logical "0". As can be discerned from the figure, both the fast code 12 and the slow code 13 contain the light source identification—in this case "101". Thus the fast code 12 conveys the light source identification codes multiple times (depending on the length of the light source identification code, in this example: six) during a transmission of the same light source identification code in the slow code 13. As for the fast codes 12, the use of balanced coding schemes (i.e. direct current (DC) free codes like the Walsh-Hadamard scheme) is especially beneficial for the slow codes 13, since such schemes provide orthogonality against the long period DC term of ambient light the sensing device will monitor. Note that the slow code 13 modulation does not influence the fast code 12 detection, as it is essentially a DC off-set for the T3 period over which a sensing device such as the photosensor 51 operates. Balanced coding schemes, like the Walsh-Hadamard, eliminate such quasi-constant off-sets.

FIGS. 4 & 5 describe the coding scheme for illustration purposes only. Alternatives schemes may be implemented without deviating from the inventive concept. For instance, also the slow codes may be implemented using a PWM scheme. Alternative to the described On-Off Keying (OOK) bi-phase modulation can be applied to implement the fast and slow codes. Note that bi-phase modulation for the slow codes has the advantage that the light signal (i.e. causing the illumination) can be changed every 2×T4 period instead of after a T5 period. This is especially advantageous in situations where the illumination system 100 comprises very many light sources 10 and consequently the light source identification code is long. This insight is based on the fact that, since a desired illumination should be constant, the duty cycle of the slow codes should be constant over a period T5. Using bi-phase modulation this constraint can be eased to a 2×T4 period.

As the slow codes 13 occur at frequencies where the human visual system shows (although low) a non-zero sensitivity, the slow code modulation is arranged to be in a predefined depth range enabling it to be invisible for the human eye while detectable for typical low cost camera systems.

In an embodiment of the illumination system 100 it comprises a light module 30, wherein the light module comprises at least four light sources 10 each emitting light of a different primary color. Thus, light module 30 constitutes a color-variable luminary. For instance the light module 30 may comprise LEDs emitting red, green, blue, and amber light as light sources. A predefined intensity & color point (XYZ, equivalent to xyY) can be implemented in a variety of different ways by mixing the constituent primary colors, due to the fact that such a 4-primary color system is overdefined. The human visual system does not distinguish whether light (color & intensity) is generated in one way or the other if the XYZ (or xyY) coordinates remain the same. Different combinations will, however, be distinguishable by the camera 40, since the camera will have a wavelength selective response different from $V_\lambda$ (the human eye luminosity function) and every light source 10 (i.e. primary color in this case) gives a different wavelength response. Thus, in an embodiment at least four light sources 10 are comprised in a light module 30. Each of the light sources in the light module is arranged to emit a primary color and the light module 30 is arranged to emit light at a desired intensity and color point (XYZ, equivalent to xyY). Furthermore the encoders 20 are arranged to implement the slow code 13 as a modulation in the relative contribution of the primary colors to the intensity (Y) and color point (xy). Thus the slow code 13 identifies in this embodiment the light module 30, not the individual constituent light sources 10. Advantageously, the human eye will not see any difference in (i) intensity (Y) and (ii) color point (xy) of a logical "1" and "0" according to this modulation scheme. In other words, no flickering will be observed. Moreover, there is no need to use a color sensitive camera (a simple black-white camera suffice) for registering the illuminations foot-prints of the different light modules, as the coding/data is embedded in the relative contribution of the primary colors to the xyY point. The only requirement is that the camera/sensor has a wavelength dependent response, such that the logical "1" and logical "0" result in a different level at the output of the camera/sensor. This is the case for typical cameras and photo sensors. When a color camera/sensor is used, additionally the color of the foot-print can be measured.

Thus, proposed is an illumination system 100 comprising a plurality of light sources 10 provided with encoders 20 arranged to enable light emitted from the light sources to comprise light source identification codes. In order to enable light effect commissioning, i.e. correlating the light sources 10 with their illumination footprints 11, the system further comprises a camera 40 arranged to register images of illumination spots 11, and a signal processor 111 arranged to derive the light source identification codes from registered images. Arranging the encoders 20 to modulate the light emitted at a frequency above a predefined high level to comprise fast codes 12 and at a frequency below a predefined low level to comprise slow codes 13, beneficially allows for the use of simple low cost camera systems.

Although the invention has been elucidated with reference to the embodiments described above, it will be evident that alternative embodiments may be used to achieve the same objective. For instance, instead of registering illumination spots 11 in the form of illuminated areas on the floor or wall of the structure 200, the camera 40 can be placed near the floor and pointed upwards for registering direct light from the light sources 10. Then the spots of light are constituted by the exit windows of the light sources. The scope of the invention is therefore not limited to the embodiments described above. Accordingly, the spirit and scope of the invention is to be limited only by the claims and their equivalents.

The invention claimed is:

1. An illumination system comprising a plurality of light sources provided with an encoder arranged to enable light emitted from the plurality of light sources to comprise light source identification codes, a camera arranged to register images of illumination spots of the light emitted from the plurality of light sources, a signal processor arranged to derive the light source identification codes from registered images, wherein the encoder is arranged to modulate the light emitted at a frequency above a predefined high level to comprise fast codes and at a frequency below a predefined low level to comprise slow codes.

2. The illumination system according to claim 1, wherein the high level is 100 Hz and the low level is 10 Hz.

3. The illumination system according to claim 1, further comprising a remote control device comprising a photo-sensor arranged to detect the fast codes and at least one lighting property related to associated light source, allowing for rapid interaction of a user with the illumination system.

4. The system according to claim 1, wherein the slow code modulation is arranged to be in a predefined depth range enabling the slow code modulation to be invisible for the human eye while detectable for the camera.

5. The illumination system according to claim 1, wherein at least four light sources are comprised in a light module, each of these light sources arranged to emit a primary color, and the light module is arranged to emit light at a desired intensity and color point (xyY), wherein further the encoders are arranged to implement the slow codes as a modulation in the relative contribution of the primary colors to the intensity and color point (xyY).

6. The illumination system according to claim 1, wherein the encoder is arranged to implement the fast codes and slow codes using a spread spectrum technique.

7. A method for processing light originating from an illumination system in a structure, the illumination system comprising a plurality of light sources, comprising the steps:

driving the plurality light sources to emit light forming illumination spots, embedding light source identification codes in the light emitted, arranging a camera in the structure enabling the camera to register the illumination spots, deriving the light source identification codes from the images registered, embedding the light source identification codes in the light emitted as fast codes at a frequency above a predefined high level and as slow codes at a frequency below a predefined low level.

* * * * *